US006364056B1

(12) United States Patent
Dantzler

(10) Patent No.: US 6,364,056 B1
(45) Date of Patent: Apr. 2, 2002

(54) SMOKE AND FIRE RESCUE SYSTEM

(76) Inventor: Cornell A. Dantzler, 10452 S. Union, Chicago, IL (US) 60628

( * ) Notice: Subject to any disclaimer, the term of this patent is extended or adjusted under 35 U.S.C. 154(b) by 0 days.

(21) Appl. No.: 09/733,553

(22) Filed: Dec. 4, 2000

(51) Int. Cl.[7] ..... G08B 6/00
(52) U.S. Cl. ..... 182/18; 116/205
(58) Field of Search ..... 182/18, 36, 70; 116/205

(56) References Cited

U.S. PATENT DOCUMENTS 5,146,641 A * 9/1992 Stolarczyk
6,025,773 A * 2/2000 Bresnan
6,073,575 A * 6/2000 Wotherspoon ..... 116/205

* cited by examiner

*Primary Examiner*—Alvin Chin-Shue

(57) ABSTRACT

A system for providing escape from a burning building. A fire resistant main cable is disposed adjacent the walls of the building at floor level leading to an exit. Rescue boxes including short cable portions are located at spaced positions which short cable portions include a harness for connecting to the main cable and a persons writs which, main cable when followed will lead to an exit containing a key to leave the building.

4 Claims, 2 Drawing Sheets

SMOKE AND FIRE RESCUE SYSTEM

BACKGROUND OF THE INVENTION

One of the difficulties encountered when a fire occurs is the ability to leave the facility to escape the fire when there is intense smoke present and thus essentially zero visibility. It can be appreciated that a novel, unique and inexpensive smoke and fire rescue system could potentially save thousands of lives each year. Those people that are trapped in smoke filed homes, schools, hotels and so forth have probably lost their sense of direction and therefore it is essential that they have quick and direct guidance to an exit door without having to be able to see the door. Disorientation is common in such a situation. Thus it has always been recognized that fire rescue systems should be located on or adjacent the floor since one trapped in a smoke filled room should stay as close to the floor as possible.

DESCRIPTION OF THE INVENTION

The present invention relates to a system which enables one trapped in a smoke filled room to escape and be lead to an exit door. The invention includes providing a fire resistant cable system that is located throughout the house and is constructed and arranged that one following the cable system will be led initially to a exit key box. The cable can be housed in a decorative continuous track. In the rescue box that is located about one foot off the floor there is located a harness that one can wrap around their wrist and the harness will be hooked on to a cable that will lead to an exit key box containing a key for opening the exit door adjacent thereto. The harness helps insure that contact with the cable will not be lost.

The cable can be housed in a separate molding secured to the wall closely adjacent the floor or disposed in a groove in which the cable will rest until use thereof is required. The molding will be designed to retain the cable in place but will readily permit the cable to be released from the molding so that the person gripping the cable can follow the cable to the rescue box and exit key box. The cable support can consist of thin flexible aluminum strips that serve as a guide for the cable and the cable will be held in position by plates that will easily give way to permit the cable to be withdrawn therefrom. The end of the cable is anchored securely to an exit key box, which contains exit keys for all exterior doors. This insures quick escape when you reach the door since there is no time lost to search for a key. Located at spaced places around the facility are rescue boxes in which is located a wrist harness to facilitate the person exiting the house to remain attached to the cable. The harness will contain a serious of clips, which would clip onto the cable and the person to whom the wrist harness is secured would merely follow the cable leading to the exit key box and thus readily exit from the smoke enclosed area. It can be seen by the attached drawings that a variety of shapes and sizes of tracks can be employed as well as different types of boxes in which the wrist harness and exit keys are located. In addition there will be a drawing showing a system employed throughout one level of a home. Of course, the system can be applied upstairs and have a cable leading down to an exit door to allow one exiting from a smoke filled room in the second floor or other living areas of the home.

DESCRIPTION OF A PREFERRED EMBODIMENT

Figure 1:
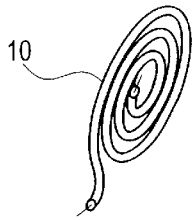
FIG. 1 shows a fire resistant rescue cable of approximately $3/16^{th}$ inch diameter which works very well in the novel rescue system.
Figure 2:
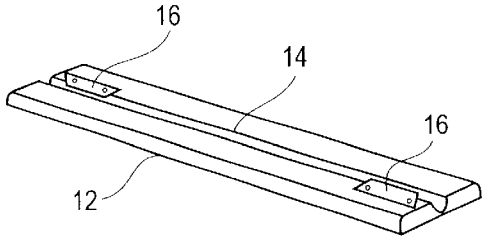
FIG. 2 illustrates a track crossing a doorway so that it will not interfere with those entering and exiting a room.
Figure 3:
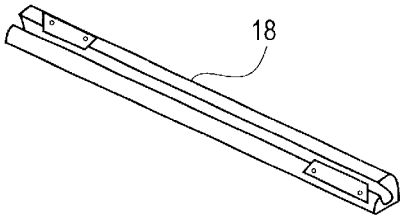
FIG. 3 shows a track that would be used to go along a baseboard.
Figure 4:
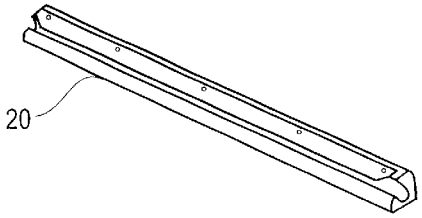
FIG. 4 is a floor or wall ceiling track with a groove contained therein.
Figure 5:
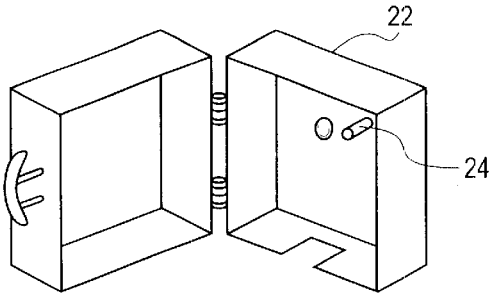
FIG. 5 shows an exit key box in which the key for opening an exit door is located.
Figure 6:
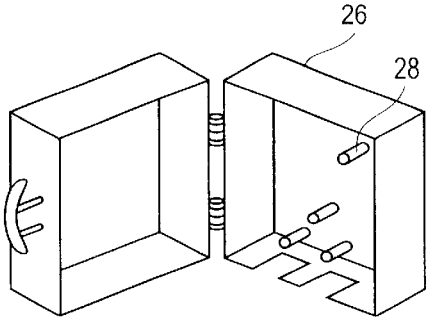
FIG. 6 shows a rescue box in which the wrist harnesses are located.
Figure 7:
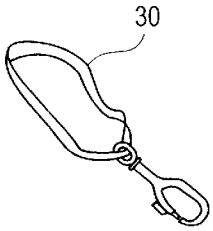
FIG. 7 shows an example of a wrist harness that can be used.
Figure 8:
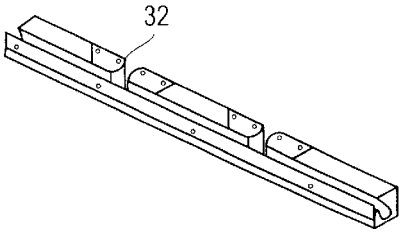
FIG. 8 shows a track for a cable leading to a rescue box.

Referring to FIG. 1 there is illustrated a fire rescue cable 10 of the type that can be used and would be disposed along or adjacent the floor, ceiling or stairs as required to provide exit from anywhere in the house. FIG. 2 shows a doorway track 12 in which is provided a groove 14 in which the cable 10 would rest. Also provided are plates 16 that extend over the groove 14 to retain the cable in position but are sufficiently resilient to permit the cable to be withdrawn from the track. FIG. 3 shows a track 18 similar to FIG. 2 which is usable to extend along the baseboard. FIG. 4 shows a floor or wall ceiling track 20 which could be employed as indicated. Referring now to FIG. 5 there is shown an exit key box 22 within which keys attached to a chain (not shown) may be located on a key pin 24. FIG. 6 shows a rescue box 26 in which there is located a hook 28 for a wrist harness 30 as shown in FIG. 7. FIG. 8 illustrates a rescue box track 32.

Figure 9:
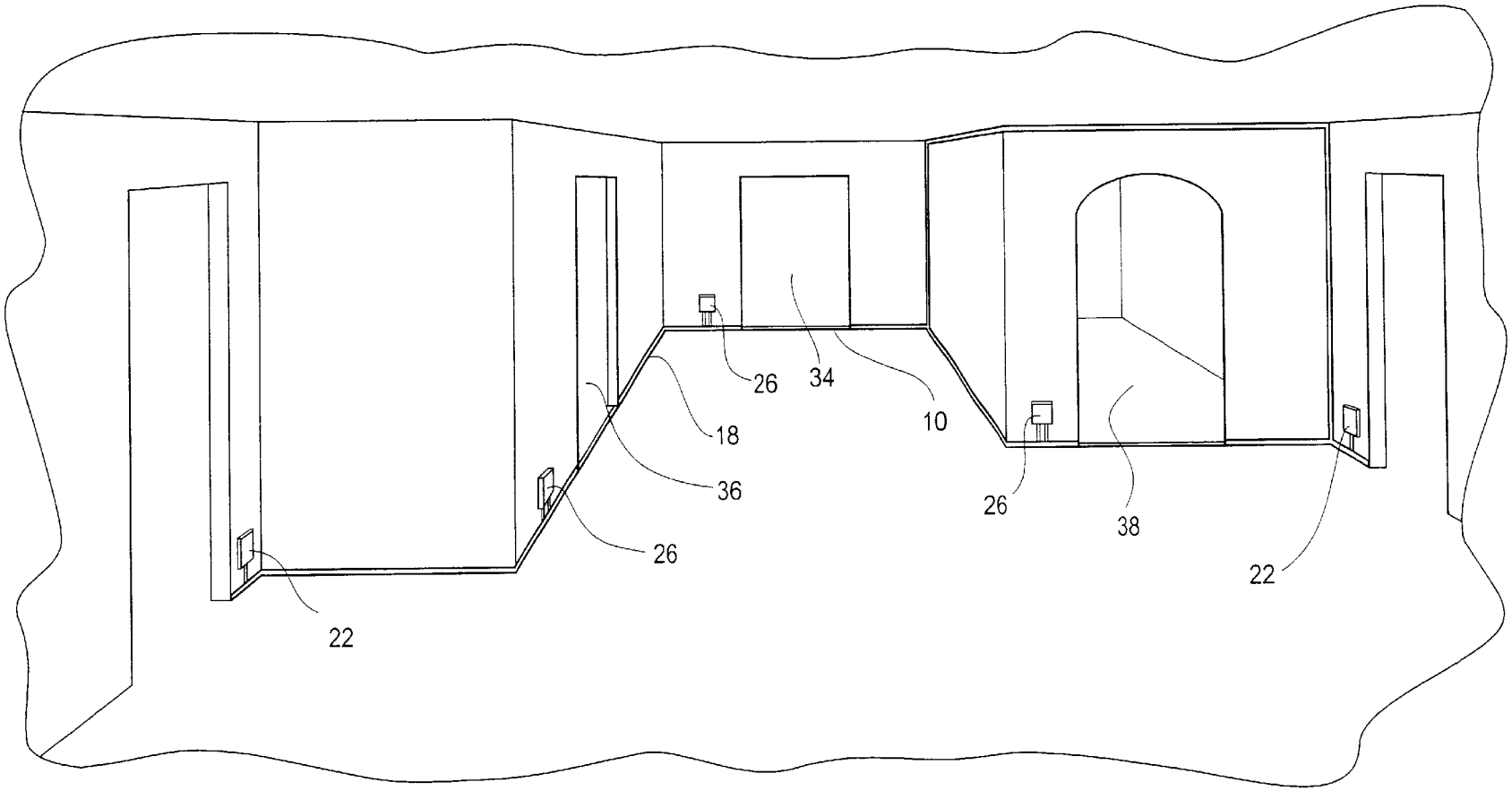
FIG. 9 shows a system employed in a home containing several bedrooms and a living room.

Turning now to FIG. 9 there is shown a floor layout of a home in which those exiting from the smoke filled bedrooms 34 or 36 would follow the track along the floor until it reached a rescue box 26 wherein the wrist harness 30 is located. The wrist harness would be placed on the person's wrist and he would continue to follow the cable 10 to the exit key box 22 from which he would remove the key and open the exit door and leave the premises. In the case of fire in the living room 38 one would move directly to the exit key box. While the system is disclosed as using tracks it could also employ readily openable clips that would serve to hold the cable in place relative to the floors or walls. Furthermore while the system has only been shown with respect to one floor it can be readily adapted to upper or lower floors as well.

In addition, the invention is also useful for firemen who enter a smoke filled area that has substantially reduced visibility. During their search for victims firemen also experience disorientation and by being able to connect into this novel system would save time and lives, and quicken rescue when seconds count. The subject smoke and fire rescue system can be seen even when there is no visibility.

It can be seen that this novel smoke and fire rescue system is simple system that can be readily introduced into a home, store, or other facility to provide for ready exit from a smoke filled room to the outside even through there was zero visibility.

What is claimed is:

1. A method for providing escape from a burning facility in which there is very limited visibility comprising of the steps of providing fire resistant main cable adjacent the walls of the facility at floor level which cable leads to an exit, locating rescue boxes at spaced positions slightly above the floor level adjacent the main cable, the rescue boxes including cable portions connected to the main cable and a harness for connecting to the cable portion which harness is wrapped around a persons wrist and who by following the main cable will be led to an exit box containing a key to leave the burning facility.

2. A method as set forth in claim 1 in which the main cable is resiliently held in place in a track.

3. A method as set forth in claim 2 in which the main cable is located in tracks in the ceilings and walls of the facility.

4. A method as set forth in claim 2 in which the track defines a groove in which the main cable is located.

* * * * *